US005094182A

United States Patent [19]

Simner

[11] Patent Number: 5,094,182

[45] Date of Patent: Mar. 10, 1992

[54] ENHANCED RIDE PLATE AND STEERING APPARATUS FOR JET DRIVE WATERCRAFT

[76] Inventor: Ronald E. Simner, 1870 Huxley Ct., San Jose, Calif. 95125

[21] Appl. No.: 673,745

[22] Filed: Mar. 21, 1991

[51] Int. Cl.[5] ..... B63H 25/06

[52] U.S. Cl. ..... 114/163; 440/42; 114/162

[58] Field of Search ..... 440/38, 40–43; 114/162, 163, 271, 270

[56] References Cited

U.S. PATENT DOCUMENTS 3,250,072 5/1966 Smith ..... 440/42 X
3,442,244 5/1969 Clark et al. ..... 114/163
3,906,885 9/1975 Woodfill ..... 440/42
3,976,026 8/1976 Eastling ..... 440/43 X
3,982,494 9/1976 Posti ..... 440/43 X

*Primary Examiner*—Edwin L. Swinehart
*Attorney, Agent, or Firm*—Rosenblum, Parish & Bacigalupi

[57] ABSTRACT

An improved ride plate apparatus for attachment to the lower aft portion of a personal watercraft, in place of the normal ride plate, and including a rudder mechanism pivotally connected to the ride plate together with steering linkage for coupling the rudder mechanism to the jet outlet nozzle so that, when the nozzle is rotated, with or without driving thrust applied, the rudder follows to effect a positive steering of the watercraft.

4 Claims, 4 Drawing Sheets

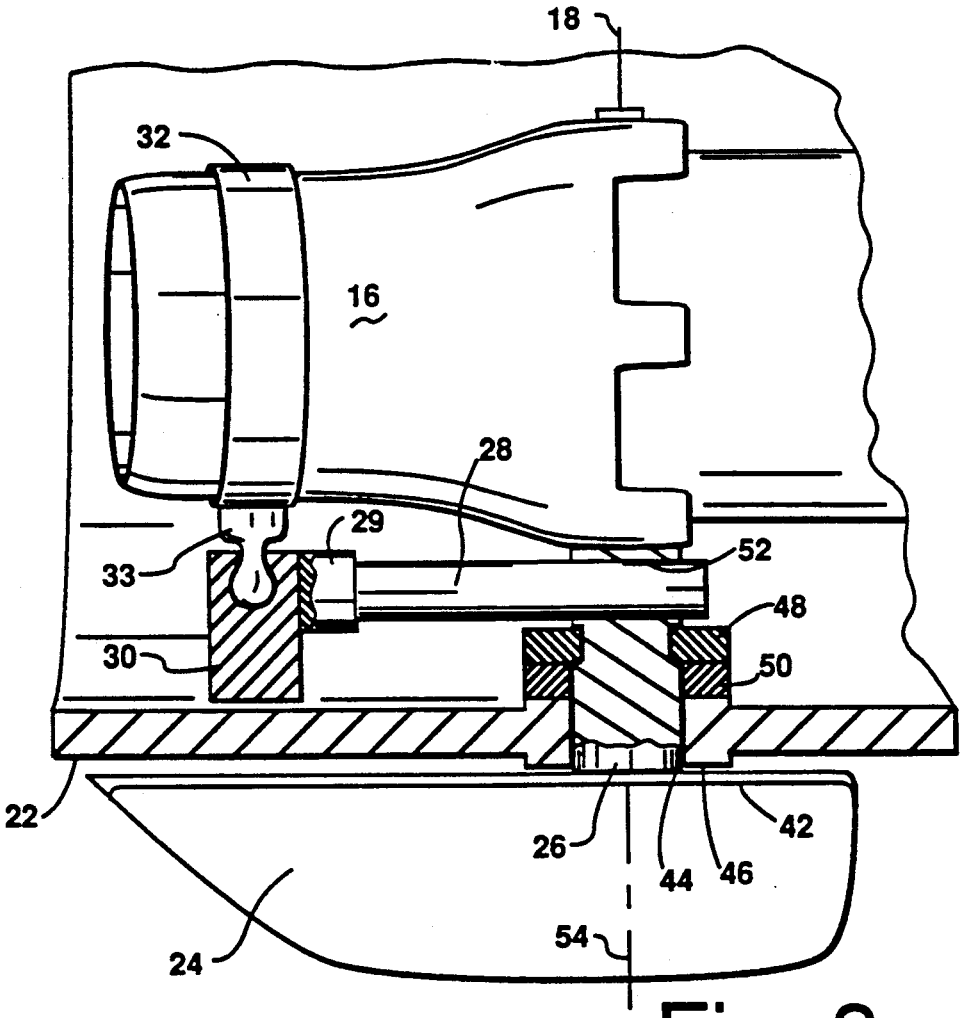
Fig. 3
Fig. 4
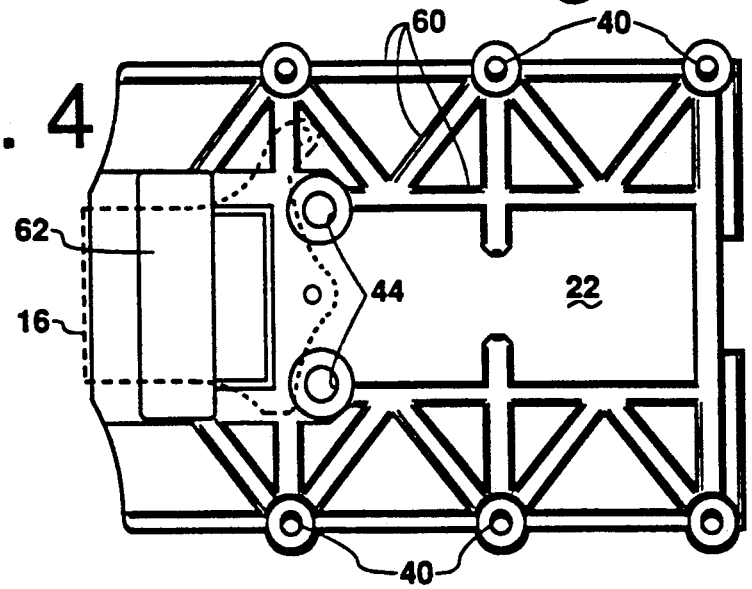

ENHANCED RIDE PLATE AND STEERING APPARATUS FOR JET DRIVE WATERCRAFT

BACKGROUND OF THE INVENTION

1. Field of the Invention

The present invention relates generally to marine jet drive apparatus and more particularly to an improved ride plate assembly for attachment to the lower aft portion of a personal watercraft and including an integral rudder subassembly and appropriate linkage for linking the rudder assembly to the jet discharge nozzle so that it follows the orientation of the nozzle.

2. Brief Description of the Prior Art

Personal watercraft employing jet drive propulsion typically use a steering nozzle to direct the jet thrust to one side or the other and thereby cause a steering rotation or yaw of the vessel which in combination with the lower hull characteristics results in a turning maneuver. However, such steering inputs cause the vessel to turn only when there is sufficient thrust to overcome the momentum and directional drag of the vessel. In other words, the combination of thrust and steering angle are required to rotate the vessel.

Water-jet propelled vessels of the type in question are disclosed in the U.S. Pat. to Tachibana et al. (No. 4,231,315) and Murase (No. 4,689,020). Note, however, that non-wetted rudder mechanisms are used.

In many circumstances the operator of a jet-propelled personal watercraft will instinctively reduce or cut the throttle in an emergency situation, such as an imminent collision. This has the adverse effect that, even though the steering mechanism is rotated to one side, the required turning thrust is reduced and the vehicle continues in the forward direction until slowed by hull drag. The desirability of providing a positive turning rudder to jet drive units used in power boats has been recognized and provided for as disclosed in the U.S. Pat. to Wildhaber, Sr. (No. 4,779,553), Kiekhaefer (No. 3,943,876), and Woodfill (No. 3,906,885). However, in none of these disclosures has there been a suggestion as to how one would appropriately modify such apparatus for application to a personal watercraft. One cannot merely apply the disclosed devices to personal watercraft because the relationship of drive to hull, the loading characteristics and the maneuvering requirements and stability of the devices are substantially different.

SUMMARY OF THE INVENTION

It is therefore a principal objective of the present invention to provide a wetted rudder apparatus for personal watercraft.

Another objective of the present invention is to provide an apparatus of the type described which can be easily affixed to a personal watercraft and linked to the jet nozzle to facilitate improved steering of the craft.

A further objective of the present invention is to provide an improved ride plate assembly having an attached rudder mechanism and associated linkage for linking the rudder mechanism to the jet drive nozzle.

Briefly, a preferred embodiment of the present invention includes an ride plate for attachment to the lower aft portion of a personal watercraft, in place of the normal ride plate, and including a rudder mechanism pivotally connected to the ride plate together with steering linkage for coupling the rudder mechanism to the jet outlet nozzle so that, when the nozzle is rotated, with or without driving thrust applied, the rudder follows to effect a positive steering of the watercraft.

An important advantage of the present invention is that it requires no modification of an existing watercraft other than removal of the conventional ride plate, substitution of the improved ride plate apparatus of the present invention, and attachment of the steering linkage to the jet drive nozzle.

Another advantage of the present invention is that it does not effect the operational characteristics of the watercraft other than to improve the steering control thereof.

These and other objects and advantages of the present invention will no doubt become apparent to those skilled in the art after having read the following detailed description of the preferred embodiments which are illustrated in the several figures of the drawing.

IN THE DRAWING

FIG. 3 is a partially broken cross-section further illustrating linkage for connection of the rudder assembly to the jet drive nozzle;

FIG. 4 is a top plan view illustrating the upper surface of an improved ride plate and the relationship of the linkage apparatus thereto;

DETAILED DESCRIPTION OF THE PREFERRED EMBODIMENTS

Figure 1:
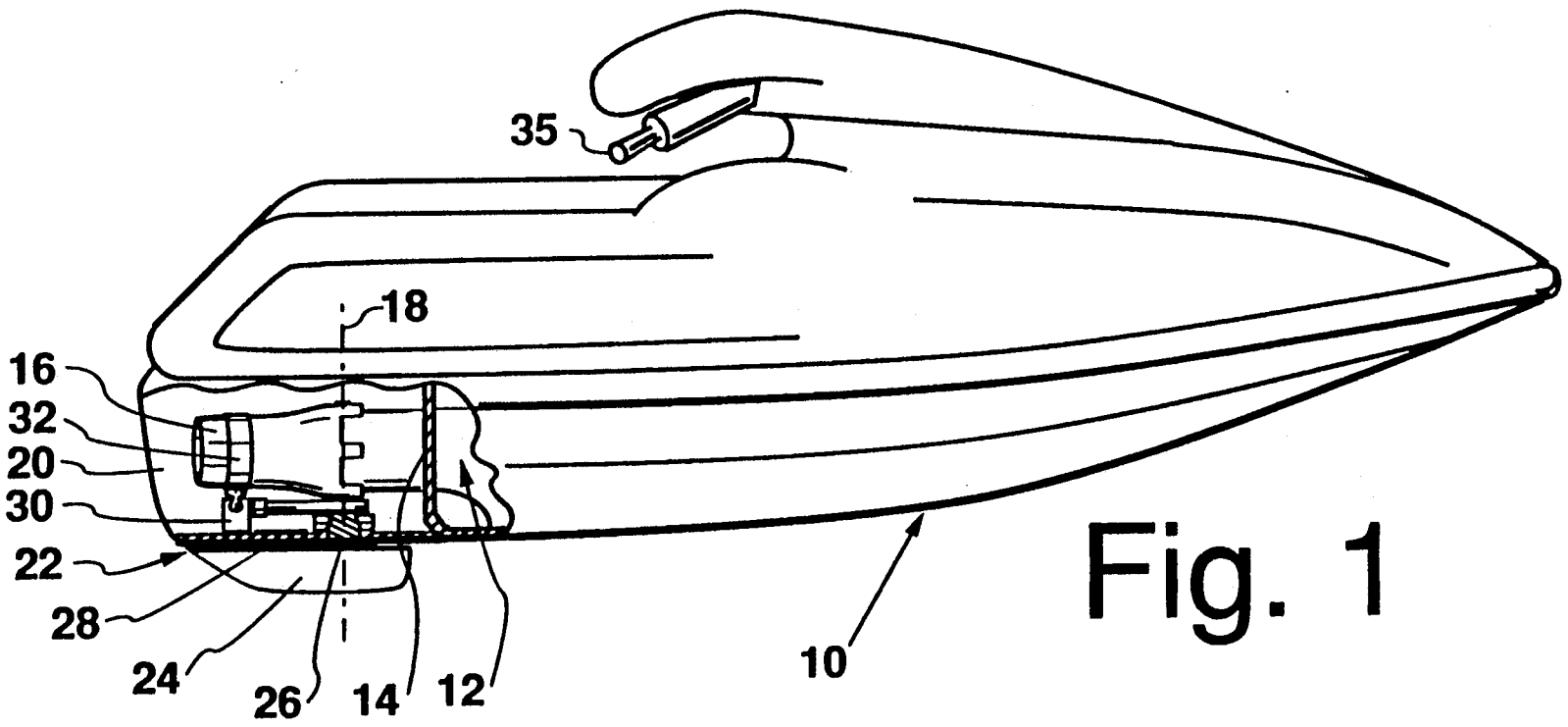
FIG. 1 is a partially broken side elevational view of a personal watercraft illustrating an improved ride plate apparatus in accordance with the present invention.

Referring now to FIG. 1 of the drawing, there is shown a personal watercraft device 10 including a jet drive unit 12 which extends through a rear bulkhead 14 and terminates in an output nozzle 16 which is pivotable about a vertical axis 18 to direct the propelling thrust of the drive unit. The nozzle 16 is disposed within an open cavity 20 formed aft of bulkhead 14 and which is open at the rear and closed at the bottom by a ride plate 22. As will be further described below, the ride plate 22 is modified in accordance with the present invention to include a rudder assembly 24 attached thereto by one or more pivot shafts 26 that extend upwardly through plate 22. Attached to the upper end of each shaft 26 is a steering arm 28 which is coupled to nozzle 16 by a pivotable connector 30 and circumscribing band 32. Alternatively, nozzle 16 could be coupled to connector 30 by means of a simple cylindrical pivot pin upstanding from connector 30 and mating with a cylindrical opening or socket formed in the bottom of nozzle 16.

It will be understood by those skilled in the art that, when a rider turns the yoke assembly 35, a conventional steering linkage (not shown) correspondingly turns duct 16 to direct the thrust to one side or the other to effect turning of the watercraft 10. In accordance with the present invention, the linkage 28 causes the rudder assembly, including one or more rudders or rudder assemblies 24, to pivot about pivot shafts 26 and provide positive turning force to watercraft 10, even in the absence of thrust from nozzle 16.

Figure 2:
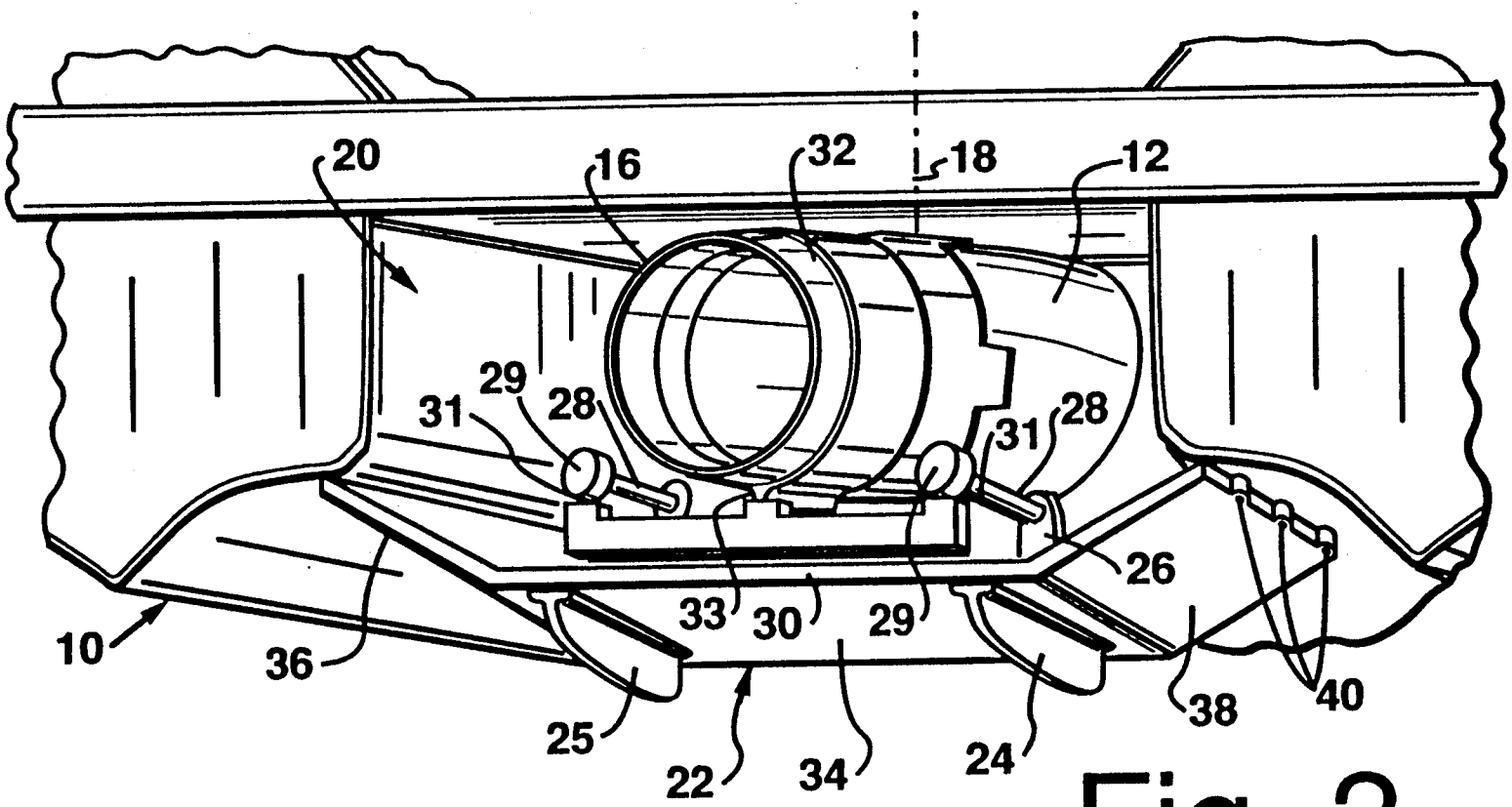
FIG. 2 is a partially broken perspective view further illustrating a ride plate apparatus in accordance with the present invention.

Turning now to FIG. 2 of the drawing, which is a partial perspective view taken from beneath and to the right rear side of vehicle 10, a better understanding of the relationship of ride plate 22 to the hull and drive unit may be seen. As depicted, ride plate 22 includes a flat central portion 34 and a pair of upwardly flared side panels 36 and 38, each of which has three apertures formed therein for receiving suitable fasteners 40 used to secure plate 22 to the superstructure of vessel 10 on each side of the cavity 20. More clearly depicted in this figure is the connector yoke 30 which is pivotally coupled to nozzle 16 by band 32 and a pivot pin 33. Note that rod ends 29 are likewise pivotally connected to the ends of yoke 30 by means of pins 31.

As nozzle 16 sweeps from left to right pivoting about its turning axis 18, it moves yoke 30 with it and in turn draws the ends of rods 28 in a following manner, which by means of the shafts 26 turn the dual rudders 24 and 25. It will of course be appreciated that as nozzle 16 swings about its pivot axis causing coupling pin 33 to swing an arc thereabout, the motion followed by the rod ends 29 will not subscribe perfect arcs about the pivot axes of rudder shafts 26. Accordingly, in order to accommodate the differential movement, the rods 28 are adapted to engage the upper ends of shafts 26 in a sliding fashion, as is more clearly depicted in the cross-section of FIG. 3.

As depicted, the rudder shaft 26 has one end rigidly attached to an upper flange 42 of rudder 24 and extends through a circular opening 44 formed in plate 22. Note that a raised surface portion 46 circumscribing opening 44 provides a sliding surface upon which rudder 24 may bear. Shaft 26 is affixed to plate 24 by means of a suitable snap ring 48, or the like, which, in cooperation with a typically nylon bearing 50, firmly secures rudder 24 to plate 22 but allows the shaft 26 to turn relative thereto. A diametral bore 52 extends through the upper portion of shaft 26 and slidingly receives one end of a turning rod 28. As previously mentioned, rod end 29 is also pivotally connected (not shown) to yoke 30 which is in turn pivotally connected by a pin 33 to a band 32 attached to nozzle 16. Accordingly, turning motion of nozzle 16 about axis 18 will result in a corresponding rotation of rudder 24 about an axis 54 which may be fore or aft of, or aligned with axis 18. If aligned with axis 18 (in the longitudinal direction of craft 10), it will be appreciated that the direction of rudder 24 will always be parallel to the thrust axis of nozzle 16. However, if positioned either fore or aft of axis 18, the turning direction of rudders 14 will be related to, but non-parallel to, the thrust axis of nozzle 16. Selection of the fore or aft offset can be selected by the manufacturer to meet the requirements of a particular application.

Note that the foremost portion of rudder 24, i.e. that portion of rudder 24 to the right of axis 54 as depicted, will impart a drag-induced turning moment about shaft 26 which is counter to that larger force imparted by the portion of rudder 24 to the left (as depicted) of axis 54 and will thereby tend to reduce the force required to turn rudder 24 during a steering movement. This relationship can likewise be adjusted to suit particular applications.

Turning now to FIG. 4, structural details of the upper surface of a particular embodiment of a ride plate in accordance with the present invention are illustrated. More specifically, the top surface of plate 22 has integrally formed ribs 60 which provide structural rigidity to the plate. Openings 44 for receiving the shafts 26 are depicted and three fastening openings 40 are shown on each side of the plate. A flattened surface portion 62 is also provided at 62 for accommodating motion of yoke 30 as shown in previous figures. Alternatively, a rectangular recess could be formed in surface portion 62 to receive a plastic or nylon slide plate for providing a low friction surface upon which yoke 30 can slide. For purposes of orientation, the location of nozzle 16 is shown in dashed lines.

Figure 5:
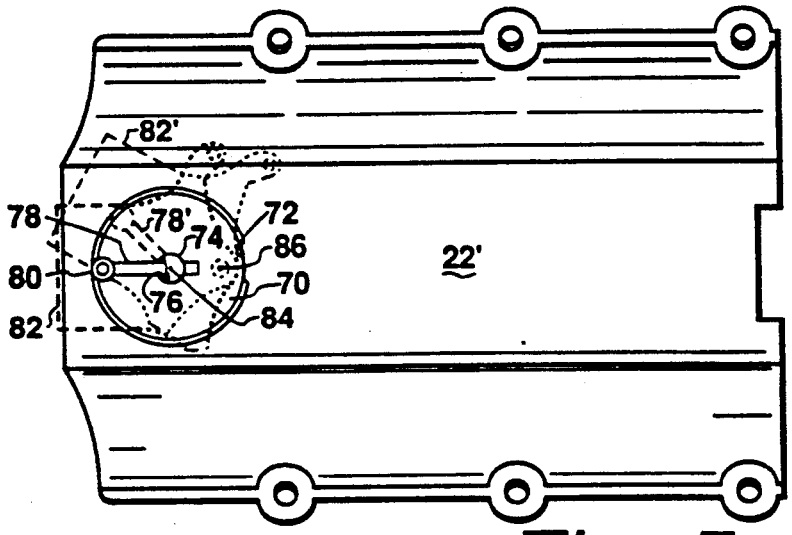
FIG. 5 is a top plan view illustrating an alternative embodiment of the present invention.
Figure 7:
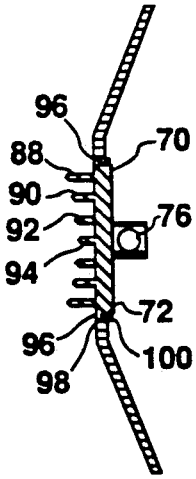
FIG. 7 is a transverse cross-section taken along the lines 7—7 of FIG. 6.
Figure 6:
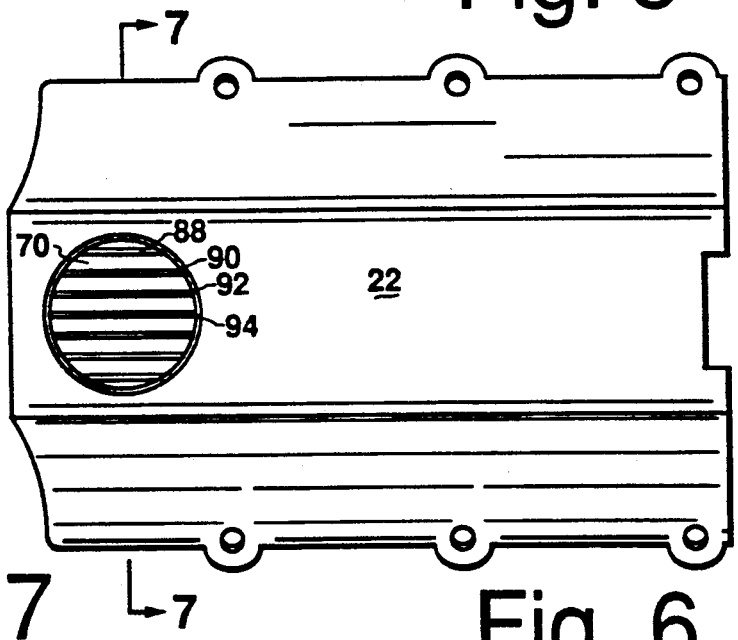
FIG. 6 is a bottom plan view of the embodiment of FIG. 5.

In FIGS. 5–7, an alternative embodiment of the present invention is disclosed wherein, instead of utilizing multiple independent rudders, a single rudder plate 70 is extended through a large opening 72 in a plate 22'. As illustrated in FIG. 5, rudder plate 70 has an upstanding stud 74 coaxially formed in the top surface thereof with a horizontally disposed bore 76 extending therethrough for receiving a turning shaft 78, the end 80 of which may be pivotally connected to a jet nozzle depicted by the dashed lines 82. As nozzle 82 is turned, as depicted by the dashed lines 82', plate 70 will likewise be turned as suggested by the dashed lines 78'. The depicted rotational axis 84 is positioned aft of the rotational axis 86 of nozzle 82 and, as a result, plate 70 will be rotated through a greater angle than that of nozzle 82. However, it is to be understood that the positioning of rotational axis 84 relative to axis 86 can be selected by the manufacturer to suit a particular application.

FIG. 6 depicts the bottom surface of plate 22' as well as the bottom surface of rudder plate 70, and shows a plurality of integrally formed, parallel and downwardly extending rudder-forming ribs 88, 90 and 92, disposed on each side of a central rudder rib 94. As further depicted in FIG. 7, which is a cross-section taken along the lines 7—7 of FIG. 6, it will be noted that the downward extension of the outermost ribs 88 is greater than that of ribs 90, 92 and 94, so that as the vehicle is turned in a particular direction, the ribs on the other side of the axis will lift out of the water at approximately the same time. It is to be understood, however, that the ribs 88–94 can be of greater or less number and the downward extension of each may be selected to suit a particular application.

As further depicted in FIG. 7, plate 70 also includes a lower flange 96 which slidably engages an annular recess 98 formed in opening 72. Plate 70 is maintained within opening 72 by means of a retainer ring 100 that is threadably or otherwise secured to the upper portion of plate 70 which extends through opening 72.

Although the present invention has been described above in terms of two particular embodiments, it is to be understood that such embodiments are merely illustrative, and numerous alterations and modifications are anticipated. For example, more than two independent rudder means may be provided. Accordingly, it is intended that the appended claims be interpreted broadly as covering all such alterations and modifications as fall within the true spirit and scope of the invention.

What is claimed is:

1. Steering apparatus for jet drive personal watercraft including a buoyant hull and a jet drive propulsion unit having a rearwardly extending nozzle rotatable about a pivot axis, comprising:

ride plate means including a generally planar central portion and side portions which angularly intersect said central portion, said side portions having means for attachment to the lower aft portion of the hull of the watercraft at a position beneath the jet drive nozzle;

rudder means extending beneath said ride plate means and pivotally connected thereto, said rudder means including a plurality of rudder components; and linkage means extending through said ride plate and coupling said rudder components to said jet drive nozzle whereby rotation of said nozzle about its pivot axis causes rotation of said rudder components about one or more rudder turning axes.

2. Steering apparatus for jet drive personal watercraft as recited in claim 1 wherein said rudder means includes first and second rudder components respectively disposed to rotate about independent axes disposed on opposite sides of the jet drive pivot axis.

3. Steering apparatus for jet drive personal watercraft as recited in claim 2 wherein said linkage means includes first and second rudder shafts which extend downwardly through openings formed in said plate means, and a rudder body forming each rudder component extending both fore and aft of its corresponding rudder axis, a fore extending portion serving to provide a counterbalancing force to the drag force applied to an aft extending portion of each rudder body during a turning operation.

4. Steering apparatus for jet drive personal watercraft as recited in claim 1 wherein said rudder means includes a circular plate journaled to said ride plate means and further includes a plurality of downwardly extending rudder forming ribs disposed in equal numbers on opposite sides of said one or more rudder axes.

* * * * *